United States Patent [19]

Victor

[11] Patent Number: 4,676,419

[45] Date of Patent: Jun. 30, 1987

[54] PERSONAL WEBBING

[75] Inventor: William E. Victor, Kanata, Canada

[73] Assignee: Her Majesty the Queen in right of Canada, as represented by the Minister of National Defence, Canada

[21] Appl. No.: 925,501

[22] Filed: Oct. 29, 1986

Related U.S. Application Data

[63] Continuation of Ser. No. 777,210, Sep. 18, 1985, abandoned.

[30] Foreign Application Priority Data

Dec. 3, 1984 [CA] Canada ..... 469143

[51] Int. Cl.[4] ..... A45F 5/00

[52] U.S. Cl. ..... 224/252; 224/253; 224/901; 224/269

[58] Field of Search ..... 224/269, 253, 271, 904, 224/224, 240, 247, 249, 252, 255, 182, 192, 215, 216, 901, 268; D2/380; 24/586, 588, 599, 601; 2/318; 248/216.1, 216.4, 217.2, 217.3, 241, 243

[56] References Cited

U.S. PATENT DOCUMENTS

| | | | |
|---|---|---|---|
| 860,395 | 7/1907 | Lindsey | 224/216 |
| 920,413 | 5/1909 | Batchelder | 224/216 |
| 1,757,475 | 5/1930 | Pratt | 206/804 X |
| 3,085,693 | 4/1963 | Shell | 248/243 X |
| 3,278,149 | 10/1966 | Brucker | 248/241 X |
| 3,570,798 | 3/1971 | Squibb | 248/243 X |
| 3,813,017 | 5/1974 | Pimsleur | 224/253 X |
| 4,098,481 | 7/1978 | Johnson et al. | 248/243 |
| 4,214,686 | 7/1980 | Dostourian | 224/269 X |
| 4,339,061 | 7/1982 | Dunn | 224/901 X |
| 4,398,655 | 8/1983 | Perry | 224/269 X |
| 4,441,640 | 4/1984 | Lottick | 224/252 |

FOREIGN PATENT DOCUMENTS

| | | | |
|---|---|---|---|
| 1068240 | 12/1979 | Canada | 224/252 |
| 1587124 | 4/1981 | United Kingdom | 224/901 |

*Primary Examiner*—Stephen Marcus
*Assistant Examiner*—Robert M. Petrik
*Attorney, Agent, or Firm*—Larson and Taylor

[57] ABSTRACT

A personal webbing system includes a novel coupling for connecting components of the system. For each two components to be connected, one of the components has at least two apertures through it, spaced apart a fixed distance. The other component is equipped with a hooking element having a resilient base and a pair of hooks projecting from the base. The spacing of the hooks is such as to permit the insertion of the hooks into the apertures when the base is flexed and to retain the hooks in the apertures when the base is relaxed. The apertures may be arranged in two parallel rows along a belt and otherwise in pairs on other components of the system. The hooking elements preferably are combined with straps carrying "Velcro" fasteners for securing the connection between the two components.

9 Claims, 4 Drawing Figures

PERSONAL WEBBING

This application is a continuation of application Ser. No. 777,210 filed Sept. 18, 1985, now abandoned.

FIELD OF THE INVENTION

The present invention relates to webbing systems, and more particularly to a coupling for connecting components of a military personal webbing system.

BACKGROUND

In a military webbing system, components of the system are attached to a webbing harness in various combinations in order to service the necessary range of load carrying requirements. Typical combinations are Fighting Order, Battle Order and Marching Order. The present invention is concerned with the provision of an improved coupling for connecting the components of such a system.

SUMMARY

According to the present invention there is provided a coupling for connecting two components of a webbing system comprising: two apertures through a first one of the components, spaced apart a predetermined distance; and a hooking element secured to a second one of the components and including a resilient base and a pair of hooks projecting from the base, the hooks having shanks spaced by said predetermined distance and oppositely projecting ends.

The resilient base may be deformed to allow engagement of the hooks in the apertures. The base then returns to its normal configuration to retain the hooks in the apertures.

The webbing system preferably includes a belt with pairs of apertures spaced apart along the belt the same distance as the spacing between the apertures of a pair. This permits the mounting of components at any location along the belt. Large or heavy components can be equipped with one or more or hooking elements which have two pairs of hooks for engagement with respective pairs of apertures.

In the most preferred embodiments, the coupling includes a strap secured to and projecting to opposite sides of the hooking element. The opposite ends of the strap carry the respective components of a hook and loop pile fastener such as that sold under the trade mark "Velcro". The strap can be wrapped and fastened around the apertured component to secure the connection of the components.

BRIEF DESCRIPTION OF THE DRAWINGS

In the accompanying drawings which illustrate exemplary embodiments of the present invention.

DETAILED DESCRIPTION

Figure 1:
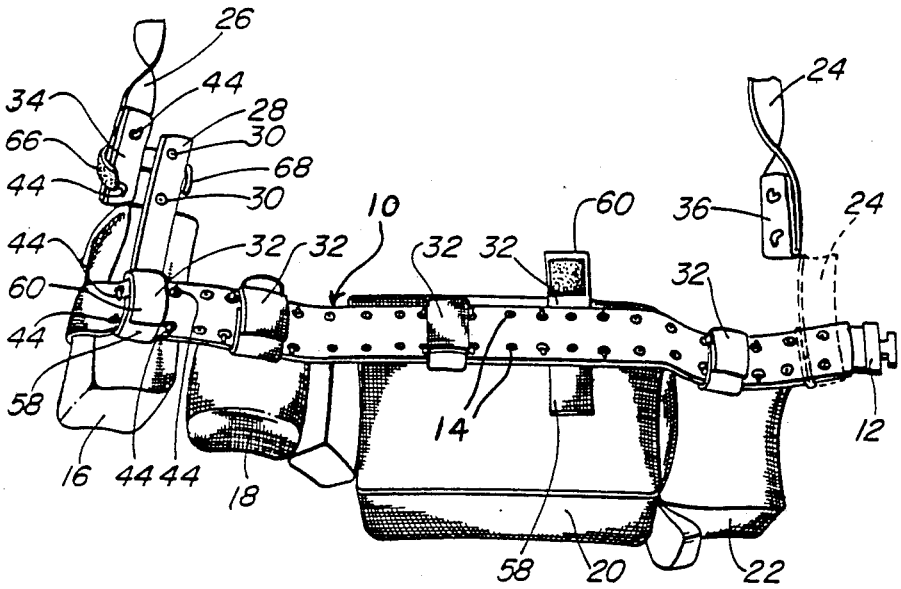
FIG. 1 is a pictorial representation showing part of a webbing system according to the present invention.

Referring to the drawings, and particularly to FIG. 1, there is illustrated a portion of a webbing system that includes a belt 10 and several other components connected to the belt. The ends of the belt are equipped with a buckle, one part of which is illustrated at 12 in the drawing.

Pairs of grommets 14 are mounted on the belt to define two rows of apertures along the top and bottom edges of the belt. The spacing of adjacent grommets across the belt is twice that along the belt. Carried on the belt, in sequence from one end to the other are a magazine carrier 16, a canteen carrier 18, a utility pouch 20 and an alternative form of magazine carrier 22. At one end of the belt is a strap 24 that leads to a yoke 76 (FIG. 4) that rides on a wearer's shoulders. A similar strap 26 is provided at the opposte end of the belt for connection to a support strap 28 forming part of the magazine carrier 16. The support strap is equipped with grommets 30 that are spaced the same distance as the spacing of grommets 14 of a pair across in the belt 10.

Each of the magazine carrier and the canteen carrier is carried to the belt 10 with a connector 32. Two such connectors are mounted on the utility pouch 20 to account for its larger size. The strap 26 is equipped with a modified form of connector 34 and the strap 24 is equipped with a further modified connector 36. These will be described in detail in the following.

Figure 3:
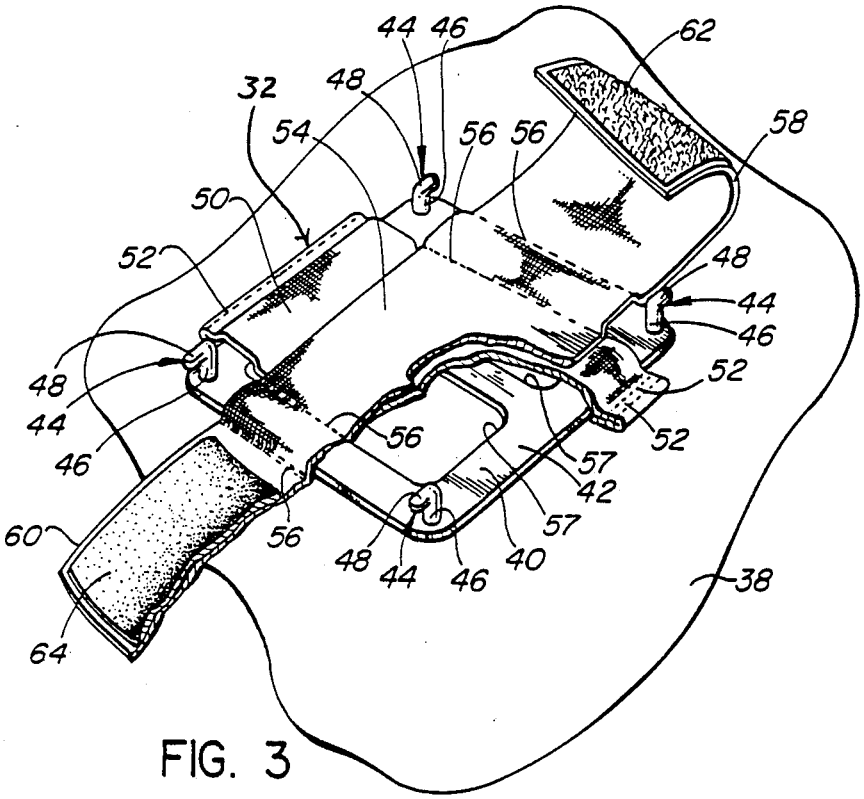
FIG. 3 is a perspective, partially broken away, showing the connecting of a hooking element to a component of the webbing system.

Referring now to FIG. 3, there is illustrated a connector 32 that is mounted on a component 38 of the webbing system. The connector includes a hooking element with a rectangular base plate 42 carrying hooks 44 at its corners. Each hook has a shank 46 and a laterally projecting end 48. The hooks are arranged with the shanks 46 spaced the same distance as the grommet spacing across the belt 10 (FIG. 1) and with the ends 48 of each pair of hooks projecting in opposite directions.

The hooking element is secured to the component 38 with a fabric strap 50 extending from side to side across the base plate 42 and overlapping the component 38 on either side, where it is secured to the component by lines of stitching 52. The connector also includes a strap 54 that extends across the base plate 42 and the strap 50 at right angles to the strap 50 and is secured to the component 38 by lines of stitching 56. In the illustrated embodiment, lines of stitching 56 are on opposite sides of the base plate 42 and also within the borders of the base, through rectangular openings 57 in the plate.

The ends 58 and 60 of the strap 54 extend beyond the hooking elements 40. They carry the respective components 62 and 64 of a hook and loop pile fabric fastener, such as is sold under the trade mark "Velcro". As shown in FIG. 3, the component 62 is on the back face of the strap end 58, while the component 64 is on the front face of the strap end 60. With this arrangement, the strap 54 may be wrapped around a component to which the hooking element is secured by the hooks and fastened in place with the "Velcro" fastener.

Reverting to FIG. 1, the embodiment of the connector illustrated at 34, mounted on strap 26 is similar to the embodiment illustrated in FIG. 3. However, the hooking element has a single pair of hooks 44 and has been held in place by folding the end of the strap 46 back over the baseplate of the hooking element and stitching the end in place. The connector 34 also includes a strap analogous to the strap 54 in FIG. 3, although in this case the strap extends laterally of the hook ends 48, rather than parallel to them. This provides for connection of the strap 26 parallel to the support strap 28 of to the magazine carrier 16.

The connector 36 associated with strap 24 does not include a strap analogous to the strap 54 of the embodiment illustrated in FIG. 3. This connector is fastened directly to the belt through the use of a two hook hooking element and two grommets 14.

Figure 2:
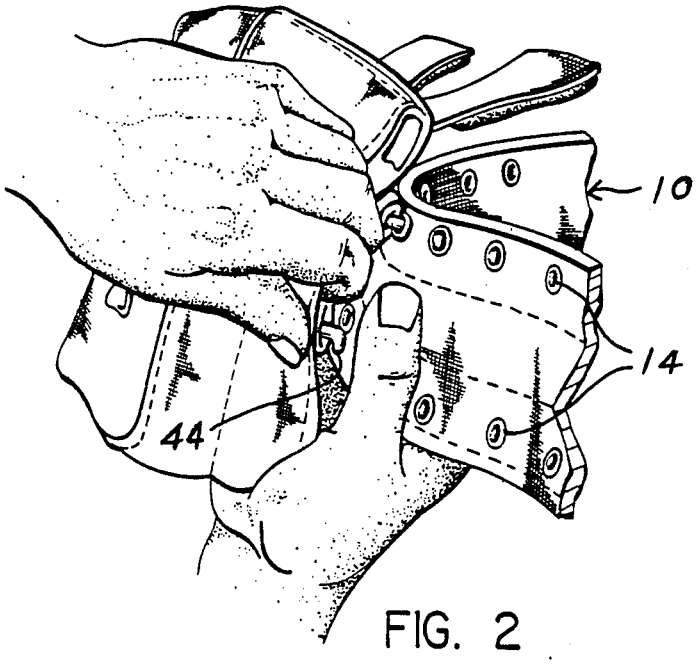
FIG. 2 is a pictorial representation showing the mounting of one component on another.

FIG. 2 illustrates the manner in which the coupling is effected. As shown in that Figure, one of the hooks 44 of each pair is hooked through a respective grommet 14, the base plate 42 is flexed with the hand to bring the other hook 44 to a position where it can be hooked into the other grommet of the respective pair. On release the backing plate flattens again and holds the hooks firmly in the respective grommets. The ends of the strap 54 are then wrapped around the grommetted component of the system and the coupling is complete.

Figure 4:
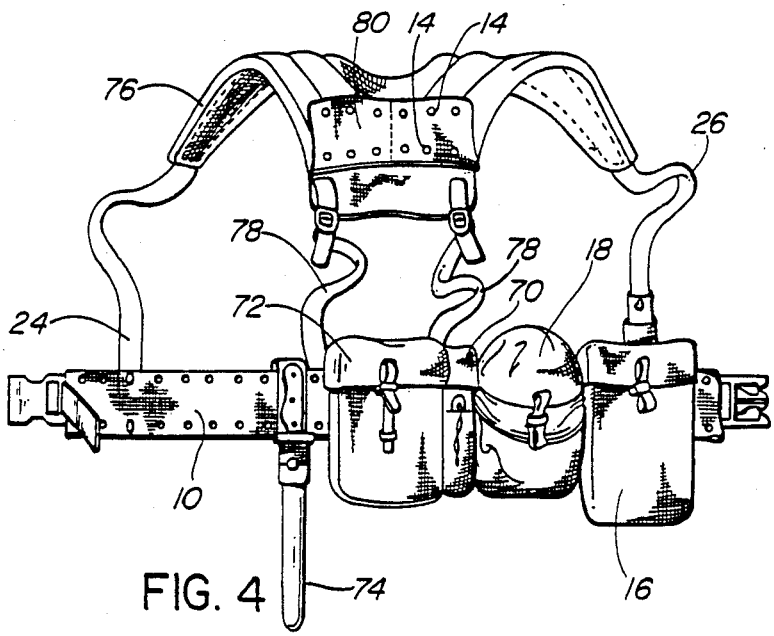
FIG. 4 is a pictorial representation of a webbing set assembled in fighting order.

FIG. 4 illustrates a webbing set assembled in fight order. The assembled webbing includes a belt 10 carrying a magazine carrier 16, a canteen carrier 18, a cutlery carrier 79, a small utility pouch 72 and a bayonet scabbard 74. Also included is a yoke 76 that is connected to the belt 10 with front straps 24 and 26, and back straps 78. The yoke serves to distribute some of the weight of the assembly onto the shoulders of a wearer. The yoke is also equipped with a band 80 on the back, with grommets 14. This grommeted band can be used to connect a small pack or accombat shovel to the webbing.

While the elements 14 in the system are referred to here in as "grommets", it is to be understood that any aperture configuration, whether reinforced or not, that is sufficiently strong to support the engaged hooking elements may be employed.

The uniform "pitch" of the grommets 14 and the hooks 44 throughout the system provides a very versatile system that can be assembled in a wide variety of combinations.

While one particular embodiment of the invention has been described in detail in the foregoing, it is to be understood that other embodiments are possible. The scope of the invention is to be ascertained solely by reference to the accompanying claims.

The embodiments of the invention which are exclusive property or privilege is claimed are defined as follows:

1. A coupling for connecting two components of a webbing system comprising:

two apertures through a first one of the components, said apertures being spaced apart a predetermined distance; and a hooking element including a resilient base and a pair of hooks projecting from the base, the hooks having shanks spaced by said predetermined distance and ends that project in opposite directions away from one another; and securing means securing the resilient base to a second one of the components, the securing means being so configured as to allow the resilient deformation of the base.

2. A coupling according to claim 1, wherein each aperture is defined by a grommet secured to the first component.

3. A coupling according to claim 1, including a strap secured to the second component with opposite ends of the strap projecting from the hooking element in opposite directions, one end having a looped pile on one face thereof and the other end having a hooked fastener engageable with the pile on the opposite face, such that the strap may be fastened around the first component.

4. A coupling according to claim 3, including a plurality of pairs of apertures through the first component, each aperture spaced from each adjacent aperture by said predetermined distance.

5. A coupling according to claim 4 wherein each aperture is defined by a grommet secured to the first component.

6. A coupling according to claim 4, wherein the hooking element includes two pairs of hooks on the resilient base, the adjacent hooks of the respective pairs being spaced by said predetermined distance.

7. A coupling according to claim 4, including plural hooking elements secured to the second component for engagement with respective pairs of apertures and the first component.

8. A coupling according to claim 4, wherein the first component is a belt with two parallel rows of apertures along the belt.

9. A coupling according to claim 8, wherein each aperture is defined by a grommet secured to the first component.

* * * * *